US008091726B2

(12) United States Patent
Bradshaw et al.

(10) Patent No.: US 8,091,726 B2
(45) Date of Patent: Jan. 10, 2012

(54) PRESSURE VESSELS WITH SAFETY CLOSURES AND ASSOCIATED METHODS AND SYSTEMS

(75) Inventors: Richard S. Bradshaw, Houston, TX (US); Robert Murphy, Kingwood, TX (US); Dale Jamison, Humble, TX (US)

(73) Assignee: Halliburton Energy Services Inc., Duncan, OK (US)

( * ) Notice: Subject to any disclaimer, the term of this patent is extended or adjusted under 35 U.S.C. 154(b) by 272 days.

(21) Appl. No.: 12/503,212

(22) Filed: Jul. 15, 2009

(65) Prior Publication Data

US 2011/0011788 A1 Jan. 20, 2011

(51) Int. Cl.

| | |
|---|---|
| ***B65D 45/02*** | (2006.01) |
| ***B65D 45/30*** | (2006.01) |
| ***B65D 50/10*** | (2006.01) |
| *B65D 50/00* | (2006.01) |
| *B01D 61/00* | (2006.01) |

(52) U.S. Cl. ..... 220/315; 210/184; 210/258; 210/416.1; 210/435; 277/483; 220/316; 220/323; 220/324; 220/327; 220/328; 73/61.43; 73/61.59; 73/152.08; 73/152.23; 73/152.25; 73/863.23

(58) Field of Classification Search ..... None
See application file for complete search history.

(56) References Cited

U.S. PATENT DOCUMENTS

| | | | | |
|---|---|---|---|---|
| 4,062,225 | A | 12/1977 | Murphy et al. | |
| D271,570 | S | 11/1983 | Cain | |
| 4,430,889 | A | 2/1984 | Sutton | |
| 4,571,988 | A | 2/1986 | Murphy | |
| 4,606,891 | A | 8/1986 | Murphy et al. | |
| 4,748,849 | A | 6/1988 | Jamison et al. | |
| 4,848,145 | A | 7/1989 | Blaschke et al. | |
| 5,086,646 | A | 2/1992 | Jamison et al. | |
| 5,309,761 | A | 5/1994 | Ravi et al. | |
| 5,361,631 | A | 11/1994 | Covington et al. | |
| 5,677,478 | A | 10/1997 | Murphy | |
| 5,703,278 | A | 12/1997 | Murphy et al. | |
| 5,819,328 | A * | 10/1998 | Lewis | 4/295 |
| 6,055,874 | A | 5/2000 | Onan et al. | |
| 6,543,276 | B2 | 4/2003 | Murphy et al. | |
| 6,584,833 | B1 | 7/2003 | Jamison et al. | |
| 6,604,852 | B1 | 8/2003 | Murphy et al. | |
| 6,851,452 | B2 * | 2/2005 | Smith | 138/89 |
| 6,906,535 | B2 | 6/2005 | Murphy et al. | |
| 7,108,066 | B2 | 9/2006 | Jamison | |

(Continued)

FOREIGN PATENT DOCUMENTS

| | | |
|---|---|---|
| EP | 0417885 A2 | 3/1991 |

(Continued)

OTHER PUBLICATIONS

US 4,531,952, Feb. 25, 1986, Murphy, (withdrawn).
2 page brochure entitled "HPHT Filter Press," copyright 2006 by Fann Instrument Company.

*Primary Examiner* — Krishnan S Menon
(74) *Attorney, Agent, or Firm* — John W. Wustenberg; McDermott, Will, Emery LLC

(57) ABSTRACT

A pressure vessel having a cell with a locking pin, and a cap and associated methods and systems. The locking pin may be configured to engage the cap when the pressure vessel is pressurized to prevent rotation of the cap without depression of the cap.

20 Claims, 5 Drawing Sheets

U.S. PATENT DOCUMENTS

| | | | | |
|---|---|---|---|---|
| 7,456,135 | B2 | 11/2008 | Kirsner et al. | |
| 7,462,580 | B2 | 12/2008 | Kirsner et al. | |
| 7,488,704 | B2 | 2/2009 | Kirsner et al. | |
| 7,534,743 | B2 | 5/2009 | Kirsner et al. | |
| 2003/0010216 | A1* | 1/2003 | Yang et al. | 99/337 |
| 2004/0129326 | A1* | 7/2004 | Smith | 138/89 |
| 2006/0231150 | A1 | 10/2006 | Jamison | |
| 2006/0254775 | A1 | 11/2006 | Jamison | |
| 2007/0078061 | A1 | 4/2007 | Kirsner et al. | |
| 2009/0096440 | A1 | 4/2009 | Murphy et al. | |
| 2010/0084403 | A1* | 4/2010 | Popish et al. | 220/318 |

FOREIGN PATENT DOCUMENTS

| | | | |
|---|---|---|---|
| EP | 1215483 | A1 | 6/2002 |
| EP | 1260809 | A1 | 11/2002 |
| EP | 1499880 | A2 | 1/2005 |
| EP | 1509758 | A1 | 3/2005 |
| WO | 03093811 | A2 | 11/2003 |
| WO | 03102551 | A1 | 12/2003 |
| WO | 2004044087 | A1 | 5/2004 |

* cited by examiner

PRESSURE VESSELS WITH SAFETY CLOSURES AND ASSOCIATED METHODS AND SYSTEMS

BACKGROUND

The present invention relates to safety closures for pressure vessels and associated methods and systems. More particularly, in certain embodiments, the present invention relates to fluid loss cells that comprise safety closures.

Measurement of the filtration behavior and cake-building characteristics of drilling fluids may be useful to predict the effects of a particular drilling fluid on surfaces of a subterranean formation. Filtration characteristics of a drilling fluid may be affected by the quantity, type, and size of solid particles and properties of the liquid components of the fluid. Temperature and pressure may influence interaction of these various components. Therefore, filtration tests are often performed at both ambient temperature and at high-temperature conditions to provide data for comparison purposes.

High-pressure high-temperature (HPHT) fluid loss cells are standard pieces of equipment used for testing the performance of drilling fluids. These HPHT fluid loss cells may be used, for example, at temperatures of up to about 600° F. and pressures up to about 5000 psi. In general, HPHT fluid loss cells comprise a cylindrical body that defines a chamber for containing a pressurized test fluid and a circular pressure cap. A ceramic or paper filter may be housed inside the pressure cap. When the pressure cap is placed on the HPHT fluid loss cell, the cell may be pressurized and fluid present in the HPHT fluid loss cell may be displaced from the HPHT fluid loss cell through the filter. The pressure cap can then be removed to evaluate fluid loss properties of the fluid.

The use of conventional HPHT fluid loss cells may be problematic. Typically, conventional HPHT fluid loss cells may be opened while the cell is under pressure. For example, the pressure cap of the cell may be held in place by set screws, which can be removed while the cell is still under pressure. Opening these HPHT fluid loss cells while under pressure may potentially cause personal injury and property damage as the caps of the HPHT fluid loss cells may come off at a high rate of speed and force. Pressurization occasionally remains after venting due to the sample fluid plugging the pressurization port. To counteract this problem, pressure indicators have been placed on some cells and caps to indicate when the cell is pressurized. While this improves safety, the cell still may be opened under pressure. In addition, a special piece of hardware has also been designed to fit over the HPHT fluid loss cell to prevent explosive ejection of the cap, if the cell is opened under pressure. While this hardware may reduce the resultant explosive ejection, the hardware still allows opening of the cell while under pressure, requiring proper use of the cell to avoid injury.

SUMMARY

The present invention relates to safety closures for pressure vessels and associated methods and systems. More particularly, in certain embodiments, the present invention relates to fluid loss cells that comprise safety closures.

In one embodiment, a pressure vessel comprises a cell with a locking pin and a cap. The locking pin may be configured to engage the cap when the pressure vessel is pressurized to prevent rotation of the cap without depression of the cap. In another embodiment, a filter press system comprises a pressure vessel with a cell having a locking pin and a cap. The locking pin may be configured to engage the cap when the pressure vessel is pressurized to prevent rotation of the cap without depression of the cap. The pressure vessel may also comprise a pressuring source for pressuring the pressure vessel, and a heating jacket for hearing the pressure vessel. In another embodiment, a method comprises providing a pressure vessel with a cell having a locking pin and a cap. The method may comprise placing the cap onto the cell, rotating the cap in relation to the cell, raising the cap in relation to the cell such that the locking pin engages the cap, and pressurizing the vessel. The locking pin may remain in engagement with the cap and prevent rotation of the cap without depression of the cap.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments, and should not be used to limit or define the invention.

DESCRIPTION OF PREFERRED EMBODIMENTS

The present invention relates to safety closures for pressure vessels and associated methods and systems. More particularly, in certain embodiments, the present invention relates to fluid loss cells that comprise safety closures.

There may be several potential advantages to the pressure vessels and systems disclosed herein. One of the many potential advantages of the pressure vessels and systems may be that they may provide a pressure vessel that cannot be opened under high-pressure conditions, thus minimizing potential safety risks and property damage. Conventional pressure vessels do not have a safety closure and thus when the conventional pressure vessel is opened under pressure; the cap can come off at a high speed and with great force. Another potential advantage of the pressure vessels and systems disclosed herein may be that they may provide a pressure vessel that is easy to assemble and disassemble without the need of tools such as wrenches and that is capable of housing multi-filter media (e.g. both paper and porous disks).

Figure 1:
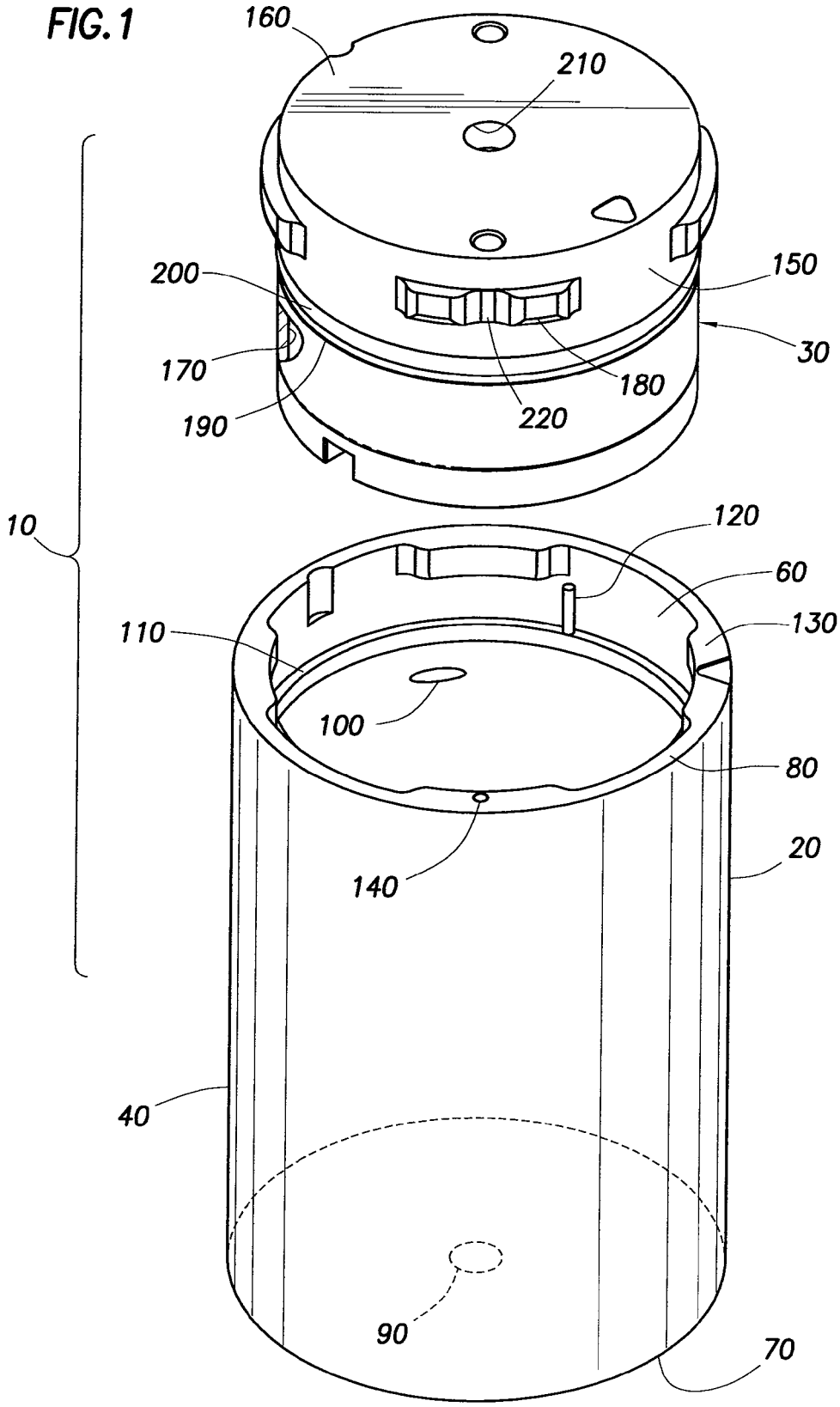
FIG. 1 is a perspective view illustration of an embodiment of a pressure vessel and cap.
Figure 3:
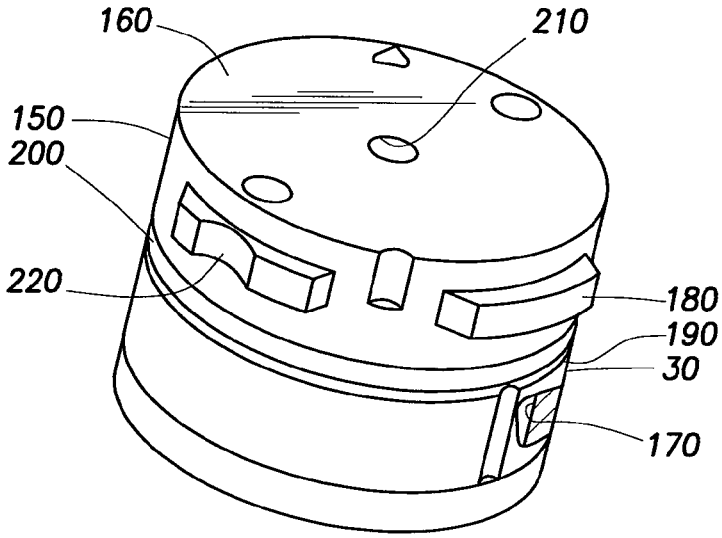
FIG. 3 is a perspective view illustration of an embodiment of a cap for a pressure vessel.
Figure 2:
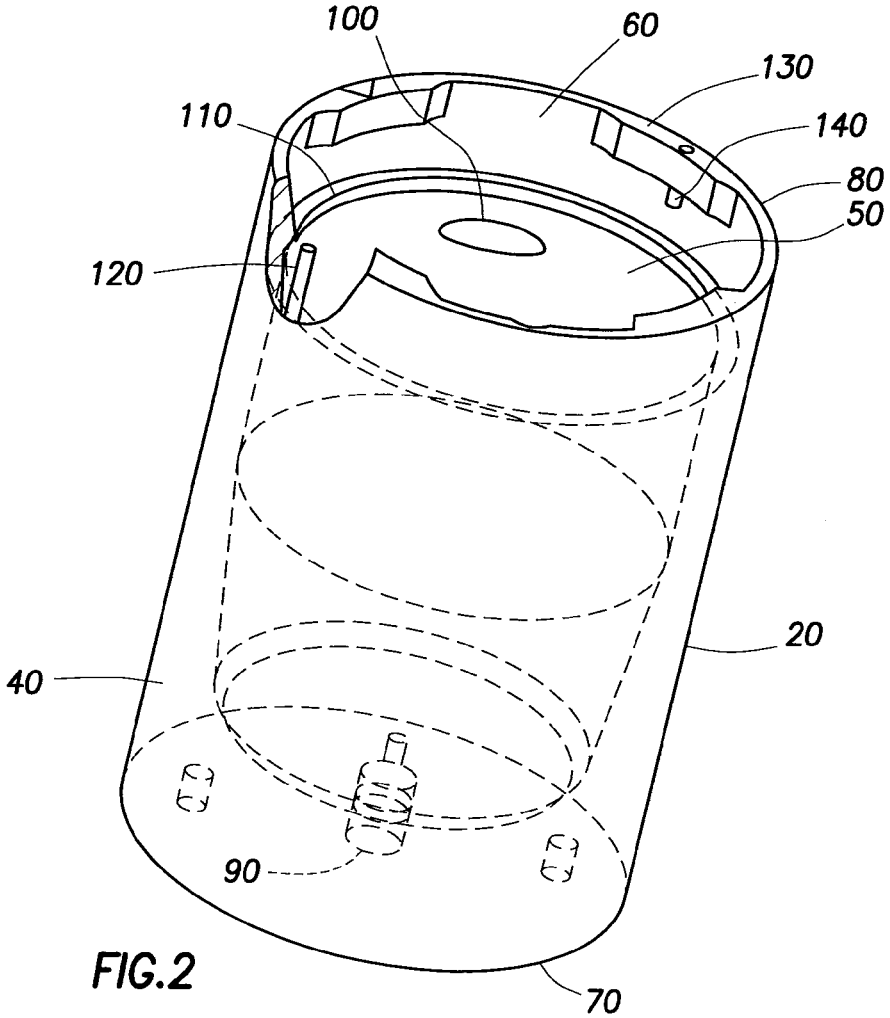
FIG. 2 is a partial cutaway, perspective view illustration of an embodiment of a pressure vessel.

Referring now to FIG. 1, a pressure vessel 10 in accordance with one embodiment is illustrated. As illustrated, pressure vessel 10 includes cell 20 and cap 30. Embodiments of pressure vessel 10 may be filled with any type of fluid. The fluid may then be heated and pressurized once cap 30 has been placed on cell 20 in a position where cell 20 may be pressurized. Cell 20 is further illustrated in FIG. 2, in accordance with one embodiment. In FIG. 2, cell 20 is illustrated in a partial cut-away view. As illustrated, cell 20 may comprise outer surface 40, inner surface 50, recessed inner surface 60, bottom surface 70, rim 80, port 90, secondary relief dimple 100, axial recess 110, rotational limit pin 120, tabs 130, and locking pin 140. Cap 30 is further illustrated in FIG. 3, in accordance with one embodiment. In FIG. 3, cap 30 is illustrated at a different rotational position than in FIG. 1. As illustrated, cap 30 may comprise outer surface 150, top surface 160, inner surface 170, ears 180, radial recess 190, ring 200, port 210, and groove 220.

Referring now to FIGS. 1 and 2, cell 20 may be a cylindrical body that defines a chamber for containing a pressurized fluid, in accordance with certain embodiments. In some embodiments, cell 20 may be constructed out of any suitable material to withstand pressures of up to about 5000 psi and temperatures up to about 600° F. In some embodiments cell 20 may be constructed out of any suitable material, preferably corrosion resistant materials. In some embodiments, cell 20 may be constructed of 300 Series stainless steel, 17-4 PH stainless steel, or any Nickel based high strength corrosion resistant alloy such as Monel or Inconel. Cell 20 may be of any suitable shape or size. In some embodiments, cell 20 may be cylindrically shaped.

Port 90 may be located in any position on cell 20. As illustrated, port 90 may be located on bottom surface 70. In some embodiments, port 90 may be a valve seat. Port 90 may be of any suitable size to allow for the filling, emptying, pressurizing, or depressurizing of cell 20 with any type of fluid. While not illustrated, additional ports may be located on cell 20.

Figure 5:
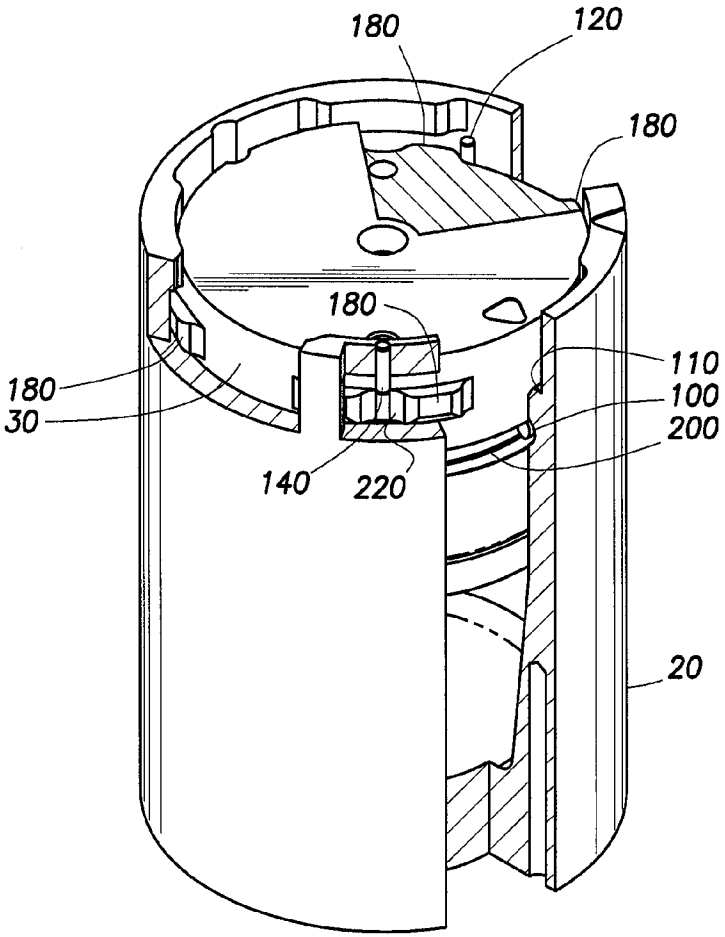
FIG. 5 is a perspective view illustration of an embodiment of a pressure vessel with a cap in a rotationally engaged position.
Figure 4:
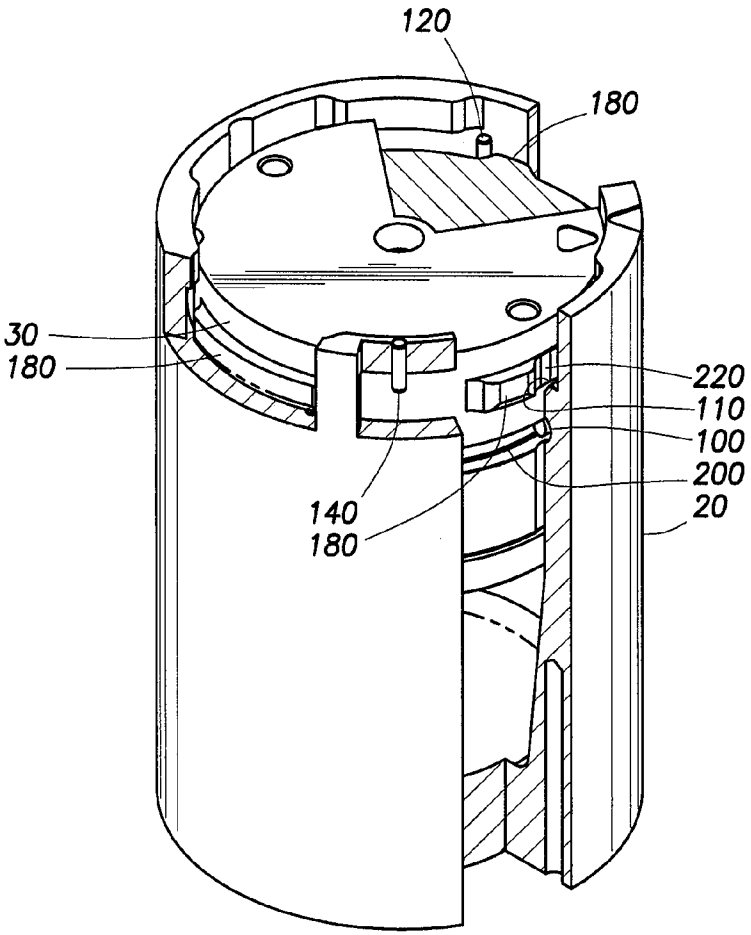
FIG. 4 is a perspective view illustration of an embodiment of a pressure vessel with a cap in an unlocked position.

Secondary relief dimple 100 may be located in any position on inner surface 50 of cell 20. Secondary relief dimple 100 may be of any suitable size or shape. In some embodiments, secondary relief dimple 100 may be positioned and shaped so that when cap 30 is placed into cell 20, ring 200 (as depicted in FIGS. 4 and 5) crosses secondary relief dimple 100 when cap 30 is in the unlocked or rotationally engaged position. While not illustrated, additional dimples may be placed on inner surface 50 of cell 20. Secondary relief dimple 100 may serve as a bypass around the sealing function of ring 200 when cap 30 is in certain positions in cell 20.

Axial recess 110 may be located in any position on cell 20. In some embodiments, axial recess 110 may be a chamfered surface. In some embodiments axial recess 110 may be positioned above secondary relief dimple 100. In some embodiments, axial recess 110 may be a chamfered surface generally forming a transition between inner surface 50 and recessed inner surface 60.

Rotational limit pin 120 may be positioned protruding from axial recess 110. As illustrated, rotational limit pin 120 may protrude toward rim 80. Rotational limit pin 120 may be constructed out of any suitable material. In some embodiments, rotational limit pin 120 may be constructed out of any suitable corrosion resistant materials. In some embodiments, rotational limit pin 120 may be constructed of 300 Series stainless steel, 17-4 PH stainless steel, or any Nickel based high strength corrosion resistant alloy such as Monel or Inconel. In some embodiments rotational limit pin 120 may be positioned and shaped so that when cap 30 is placed into cell 20, rotational limit pin 120 engages an end of one of ears 180 of cap 30 when cap 30 is in the unlocked position (e.g., as depicted in FIG. 4) or the rotationally engaged position (e.g., as depicted in FIG. 5). While not illustrated, additional rotational limit pins may be positioned protruding from axial recess 110. While not illustrated, rotational limit pin 120 may be positioned protruding from one of ears 180 of cap 30 toward top surface 160. When rotational limit pin 120 is positioned protruding from one of ears 180, rotational limit pin 120 may be positioned and shaped so that when cap 30 is placed on cell 20, rotational limit pin 120 engages the end of one of tabs 130 of cell 20 when cap 30 is in the unlocked position or the rotationally engaged position.

Tabs 130 may be positioned on recessed inner surface 60 extending toward rim 80. As illustrated, tabs 130 may extend up to rim 80. In some embodiments, tabs 130 may extend out from recessed inner surface 60 to the plane of inner surface 50. In the illustrated embodiment, four tabs 130 are spaced around recessed inner surface 60. Tabs 130 may be evenly spaced around recessed inner surface 60 or may spaced around recessed inner surface 60 at different intervals. Tabs 130 may be constructed out of any suitable material to withstand pressures of up to about 5000 psi and temperatures up to about 600° F.

Figure 6:
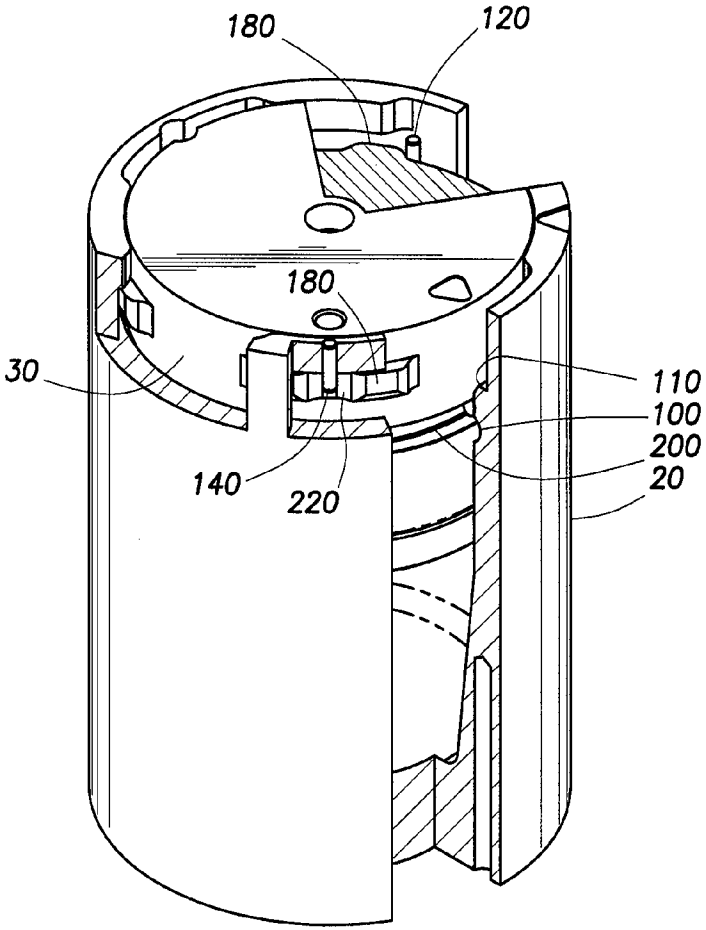
FIG. 6 is a perspective view illustration of an embodiment of a pressure vessel with a cap in a locked position.

Locking pin 140 may protrude down from one of tabs 130 in the direction of recessed inner surface 60. In some embodiments locking pin 140 may be positioned and shaped so that when cap 30 is placed on cell 20, locking pin 140 aligns with groove 220 of one of ears 180 of cap 30 when cap 30 is in the rotationally engaged position (e.g., as depicted in FIG. 5). In some embodiments, locking pin 140 may be positioned and shaped so that when cap 30 is placed on cell 20, locking pin 140 engages groove 220 of one of ears 180 of cap 30 when cap 30 is in the locked position (e.g., as depicted in FIG. 6). While not illustrated, additional locking pins may be placed on inner surface 50 of cell 20. Locking pin 140 may be constructed out of any suitable material to withstand pressures of up to about 5000 psi and temperatures up to about 600° F. In some embodiments, locking pin 140 may be constructed out of any suitable corrosion resistant materials. In some embodiments, locking pin 140 may be constructed of 18-8 stainless steel.

Referring now to FIGS. 1 and 3, cap 30 may be a circular body designed to seal one end of cell 20, in accordance with certain embodiments. Cap 30 may have outer surface 150, top surface 160, inner surface 170, ears 180, radial recess 190, ring 200, port 210, and groove 220. Cap 30 may be constructed out of any suitable material to withstand pressures of up to about 5000 psi and temperatures up to about 600° F. In some embodiments, cap 30 may be constructed out of any suitable corrosion resistant materials. In some embodiments, cap 30 may be constructed of 300 Series stainless steel, 17-4 PH stainless steel, or any one Nickel based high strength corrosion resistant alloy such as Monel or Inconel. Cap 30 may be of any suitable size and shape so that it may be placed into a portion of cell 20.

Port 210 may be located in any position on cap 30. As illustrated, port 210 may be located on top surface 160. In some embodiments, port 210 may be a valve seat. Port 210 may be of any suitable size to allow for the filling, emptying, pressurizing, or depressurizing of cell 20 with any type of fluid when cap 30 is placed on cell 20. In some embodiments, port 90 in conjunction with port 210 allow for fluid to pass through pressure vessel 10. While not illustrated, additional ports may be located on cap 30.

Ears 180 may protrude outward from outer surface 150 of cap 30. In some embodiments one or more of ears 180 may comprise a groove 220 shaped to engage locking pin 140 of cell 20 when in the locked position. In the illustrated embodiment, ears 130 are evenly spaced around outer surface 150 of cap 30. Alternatively, ears 180 may be spaced around outer surface 150 at different intervals. In certain embodiments, ears 180 may be disposed around outer surface 150 such that ears 180 fit between tabs 130 when cap 30 is placed onto cell 20. Ears 180 may be constructed out of any suitable material to withstand pressures of up to about 5000 psi and temperatures up to about 600° F.

Radial recess 190 may be positioned on cap 30 below ears 180 on outer surface 150 of cap 30. Radial recess 190 may be sized to accommodate ring 200. In some embodiments, ring 200 may comprise an O-ring or a quad-ring. Ring 200 may be constructed out of any suitable material known by those of ordinary skill in the art. In some embodiments radial recess 190 may be positioned on outer surface 150 of cap 30 so that when cap 30 is placed in cell 20 in the unlocked or rotationally engaged positions, ring 200 crosses secondary relief dimple 100. When ring 200 is positioned to cross secondary relief dimple 100, a seal may not be formed because the secondary relief dimple 100 may act as a bypass to allow fluid to escape pressure vessel 10.

Cap 30 may be placed into a portion of cell 20 in various configurations. Three of these configurations, the unlocked position, the rotationally engaged position, and the locked position, are discussed further below.

FIG. 4 depicts an embodiment of a pressure vessel 10 with cap 30 in an unlocked position. When an embodiment of the pressure vessel 10 is in an unlocked position, cap 30 may be placed on cell 20 in such a manner that the pressure vessel 10 cannot become pressurized, in accordance with certain embodiments. As can be seen by FIG. 4, cap 30 may be placed into cell 20 in a manner such that ears 180 seat against axial recess 110, ring 200 crosses secondary relief dimple 100, and one of ears 180 rests against rotational limit pin 120. In this position, locking pin 140 may not align with groove 220 of one of ears 180. In this position, rotational limit pin 120 only allows cap 30 to be rotated towards the rotationally engaged and locked positions. In this embodiment, cell 20 cannot become pressurized because a seal cannot be formed while ring 200 is positioned to cross secondary relief dimple 100. In this embodiment, ears 180 and tabs 130 are not aligned so that cap 30 can be removed from cell 20 without rotating cap 30 or cell 20.

FIG. 5 depicts an embodiment of a pressure vessel 10 with cap 30 in a rotationally engaged position. When an embodiment of the pressure vessel 10 is in a rotationally engaged position, cap 30 may be placed on cell 20 and then rotated in such a manner that cap 30 cannot be removed from cell 20 without rotating cap 30 or cell 20. As can be seen by FIG. 5, cap 30 may be rotated in a manner such that ears 180 seat against axial recess 110, ring 200 is bypassed by secondary relief dimple 100, and another one of ears 180 rests against rotational limit pin 120. In this position, locking pin 140 may be rotationally aligned with groove 220 of one of ears 180. In this position, rotational limit pin 120 may only allow cap 30 to rotate towards the unlocked position. In this embodiment, ears 180 and tabs 130 are aligned preventing the removal of cap 30 without either rotating cap 30 or cell 20 to the unlocked position. In this embodiment, cell 20 cannot pressurize because a seal cannot be formed while ring 200 is bypassed by secondary relief dimple 100.

FIG. 6 depicts an embodiment of a pressure vessel 10 with cap 30 in a locked position. When an embodiment of the pressure vessel 10 is in a locked position, cap 30 has been placed on cell 20, rotated in such a manner so that it is in the rotationally engaged position, and then raised. As used herein, raising cap 30 refers to moving cap 30 away from cell 20 along the longitudinal axis of pressure vessel 10. As can be seen by FIG. 6, cap 30 may be placed onto cell 20, rotated, and raised in a manner such that ears 180 seat against tabs 130, ring 200 is not positioned to cross secondary relief dimple 100, one of ears 180 rests against rotational limit pin 120, and locking pin 140 is engaged with groove 220 of one of ears 180. In this position, locking pin 140 may prevent cap 30 from rotating towards an unlocked position. In this embodiment, cell 20 can become pressurized. Once pressurized to, for example, over about 10 psi, cap 30 cannot be removed from cell 20 because the pressure inside cell 20 prevents cap 30 from being manually pushed in toward cell 20 in the axial direction and from switching to a rotationally engaged position. It should be understood that cap 30 may still be rotated and removed from cell 20 if the pressure within pressure vessel can be overcome. Only when the pressure in cell 20 is reduced, for example, to approximately 10 psi or less, can cap 30 be depressed by hand to a rotationally engaged position. As used herein, depressing cap 30 refers to moving cap 30 toward cell 20 along the longitudinal axis of pressure vessel 10.

In some embodiments, cell 20 and cap 30 may be used as an HPHT fluid loss cell. The HPHT fluid loss cell may be used to subject fluids to permeability plugging tests. By way of example, a fluid may be introduced into cell 20 and an embodiment of cap 30 comprising a filter may be placed onto cell 20 and placed in a locked position. Cell 20 may then be heated and/or pressurized. The fluid in cell 20 may then be forced to flow through the filter and the filter can subsequently be removed to evaluate fluid loss properties of the fluid.

Figure 7:
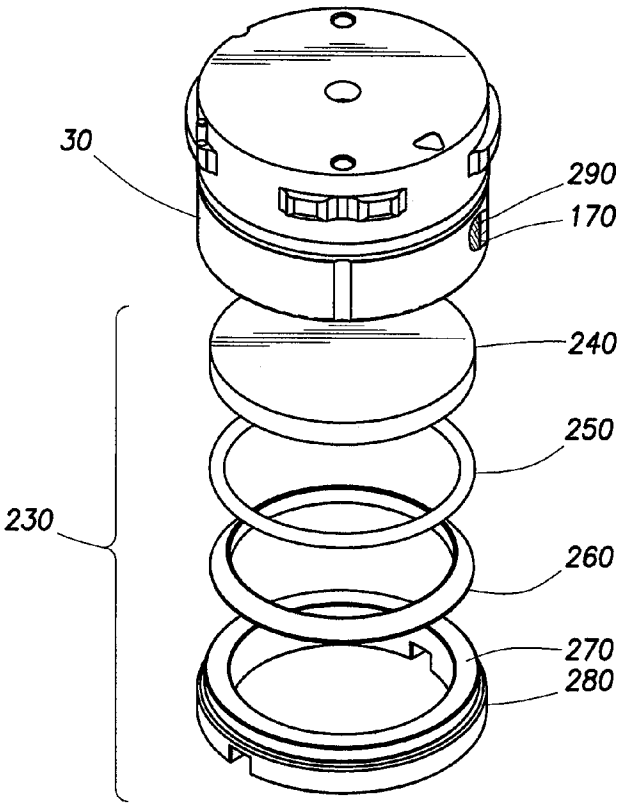
FIG. 7 is an exploded view illustration of an embodiment of a cap for an HPHT fluid loss cell.

FIG. 7 depicts a cap for an HPHT fluid loss cell with a disk filter system, in accordance with certain embodiments. Cap 30 may comprise disk filter system 230. In some embodiments, disk filter system 230 may comprise filter disk 240, O-ring 250, ring 260, and retaining cap 270. While FIG. 7 illustrates a single ring 260, the present technique also encompasses use of a disk filter system with multiple rings. Filter disk 240 may be constructed out of any suitable porous ceramic, metallic, or other material, which can act as a filter and meets strength and temperature requirements. In some embodiments, filter disk 240 may have a 10-micron mean pore diameter, for example part number 210538, available from Fann Instrument Company of Houston, Tex. In other exemplary embodiments, filter disk 240 may have other mean pore diameters, suitable for the particular conditions. Filter disk 240 may be positioned such that it contacts inner surface 170 of cap 30 and O-ring 250. Ring 260 may be positioned such that it contacts O-ring 250 and retaining cap 270. Ring 260 may be constructed out of any suitable material. Example materials include 300 Series stainless steel, 17-4 PH stainless steel, or any Nickel based high strength corrosion resistant alloy such as Monel or Inconel or any suitable material to withstand temperatures up to about 600° F. Retaining cap 270 may be constructed of 300 Series stainless steel, 17-4 PH stainless steel, or any Nickel based high strength corrosion resistant alloy such as Monel or Inconel or any suitable material to withstand temperatures up to about 600° F. Retaining cap 270 may have threads 280, which may be designed to engage threads 290 located on inner surface 170 of cap 30. When disk filter system 230 is installed on cap 30, disk 240, O-ring 250, and ring 260 may be secured between retaining cap 270 and cap 30, and disk filter system 230 may be able to filter fluid passing there through.

Figure 8:
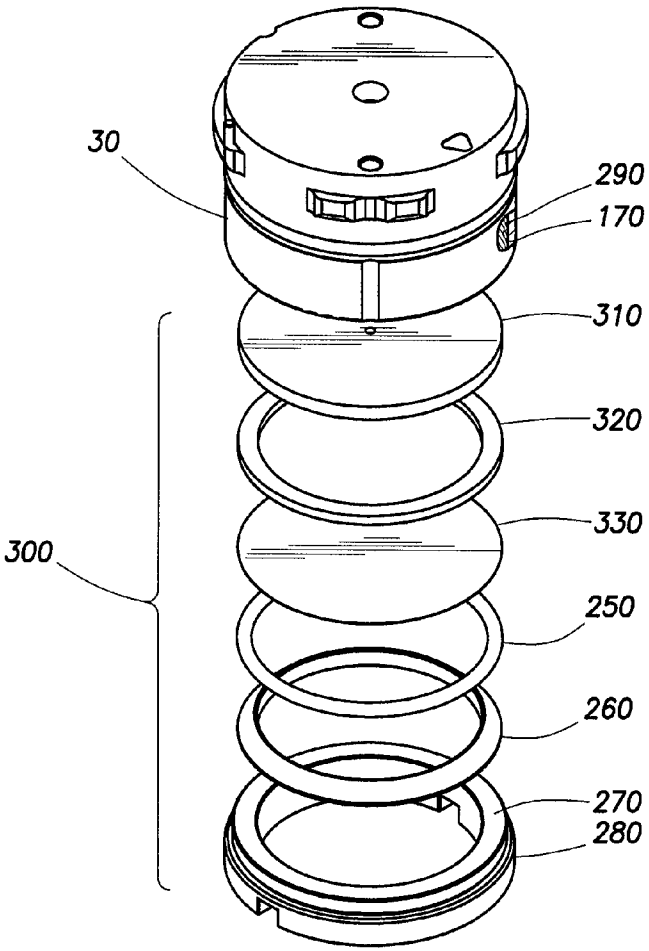
FIG. 8 is an exploded view illustration of an embodiment of a cap for an HPHT fluid loss cell.

FIG. 8 depicts an embodiment of cap 30 for an HPHT fluid loss cell with a paper filter system. Referring now to FIG. 8, cap 30 may have paper filter system 300. In some embodiments, paper filter system 300 may comprise spacer disk 310, back-up screen 320, paper filter 330, O-ring 250, ring 260, and retaining cap 270. While FIG. 8 illustrates a single ring 260, the present technique also encompasses use of a paper filter system with multiple rings (not shown). Spacer disk 310 may be constructed of 300 Series stainless steel, 17-4 PH stainless steel, or any Nickel based high strength corrosion resistant alloy such as Monel or Inconel or any suitable material to withstand pressures of up to about 5000 psi and temperatures up to about 600° F. Spacer disk 310 may be positioned so that it contacts inner surface 170 of cap 30 and back-up screen 320. Spacer disk 310 may be sized such that identical caps 30, O-ring 250, ring 260, and retaining cap 270 may be used in conjunction with either disk filter system 230 or paper filter system 300. Back-up screen 320 may be positioned to contact spacer disk 310, and paper filter 330. Back-up screen 320 may be constructed out any suitable material. One preferred embodiment may be a stainless steel screen of 60-mesh. Other embodiments may be two stacked screens, such as a 325-mesh screen with a 60-mesh screen therebehind. Paper filter 330 may be positioned to contact back-up screen 320, O-ring 250, and ring 260. Paper filter 330 may be constructed out any suitable paper filter material. For example, paper filter 330 may meet specifications of the American Petroleum Institute. In some embodiments, paper filter 330 may be a calendared, hardened, qualitative low-ash filter paper, which may be a very slow, extra dense paper made from 100% cotton linters with a lint-free surface, resistant to acid and alkaline solutions, such as, for example, part numbers 206056 (N8800) and 206051 (N8700), available from Fann Instrument Company of Houston, Tex. In certain high-temperature embodiments, paper filter 330 may comprise fiberglass paper. Ring 260 may be positioned so that it contacts O-ring 250 and retaining cap 270. When paper filter system 300 is installed on cap 30, spacer disk 310, back-up screen 320, paper filter 330, O-ring 250, and ring 260 may be secured between retaining cap 270 and cap 30, and paper filter system 300 may be able to filter fluid passing through.

Figure 9:
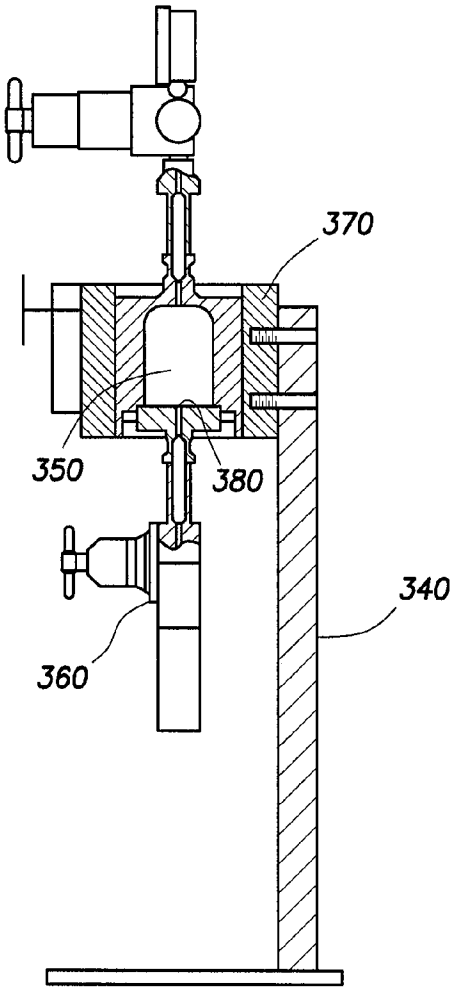
FIG. 9 is a cross-sectional side view illustration of an embodiment of an HPHT filter press system.

In certain embodiments, the HPHT fluid loss cell may be used as part of a filter press system 340. Referring now to FIG. 9, filter press system 340 may include HPHT fluid loss cell 350, $CO_2$ pressuring unit 360, and heating jacket 370. By way of example, HPHT fluid loss cell 350 may be filled with a fluid, sealed, and inverted. $CO_2$ pressuring unit 360 may be connected in fluid communication with HPHT fluid loss cell 350 via port 380. HPHT fluid loss cell 350 may be placed in heating jacket 370. HPHT fluid loss cell 350 may then be heated and/or pressurized to the desired test conditions.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Moreover, the indefinite articles "a" or "an," as used in the claims, are defined herein to mean one or more than one of the element that it introduces. Also, the terms in the claims have their plain, ordinary meaning unless otherwise explicitly and clearly defined by the patentee.

What is claimed is:

1. A filter press system comprising:

a pressure vessel comprising:

a cell having an inner surface that defines at least one secondary relief dimple, a recessed inner surface transitioned from the inner surface, and a plurality of tabs extending radially inward from the recessed inner surface; and a cap configured to be received at least partially within the cell and having an outer surface, a radial recess defined in the outer surface, a ring disposed within the radial recess, and a plurality of ears protruding outward from the outer surface;

a pressuring source configured to inject a fluid to pressurize the pressure vessel; and a heating jacket disposed about the cell.

2. The filter press system of claim 1 wherein the pressure vessel further comprises a filter system disposed within the cap.

3. The filter press system of claim 2 wherein the cell defines a first port in a bottom surface of the cell and the cap defines a second port in a top surface of the cap.

4. The filter press system of claim 1 wherein a groove is defined on at least one of the plurality of ears.

5. The filter press system of claim 4 wherein the cell further comprises a locking pin protruding axially from at least one of the plurality of tabs, the locking pin being configured to engage the groove and thereby prevent the cap from reverse rotation.

6. The filter press system of claim 5 wherein the cell further comprises a rotational limit pin extending axially from an axial recess defined on the inner surface.

7. The filter press system of claim 6 wherein the rotational limit pin is configured to contact a first tab of the plurality of tabs when the pressure vessel is in an unlocked position and a second tab of the plurality of tabs when the pressure vessel is in a rotationally engaged position.

8. The filter press system of claim 1 wherein the at least one secondary relief dimple is configured to provide a bypass of a seal formed between the cell and the cap when the pressure vessel is in an unlocked position or a rotationally engaged position.

9. The filter press system of claim 8 wherein, when the pressure vessel is in the unlocked or rotationally engaged positions, the radial recess and ring are radially-aligned with the at least one secondary relief dimple, thereby providing the bypass.

10. The filter press system of claim 9 wherein, when the pressure vessel is in a locked position, the radial recess and ring are axially-offset from the at least one secondary relief dimple and the ring seals against the inner surface of the cell.

11. The filter press system of claim 9 wherein, when the pressure vessel is in a locked position, the plurality of ears seat against the plurality of tabs.

12. The filter press system of claim 9 wherein the ring is an o-ring seal.

13. The filter press system of claim 1 wherein the pressuring source is fluidly coupled to the first port and the second port allows the fluid to pass through the filter system and out of the pressure vessel.

14. The filter press system of claim 2 wherein the pressuring source is a $CO_2$ pressuring unit.

15. A method of sealing a pressure vessel and subjecting a drilling fluid to a permeability plugging test, comprising:

introducing the drilling fluid into the pressure vessel, the pressure vessel comprising:

a cell having an inner surface that defines at least one secondary relief dimple, a recessed inner surface transitioned from the inner surface, and a plurality of tabs extending radially inward from the recessed inner surface; and a cap configured to be received at least partially within the cell and having an outer surface, a radial recess defined in the outer surface, a ring disposed within the radial recess, and a plurality of ears protruding outward from the outer surface;

inserting the cap at least partially into the cell such that the plurality of ears seat against an axial recess defined on the inner surface of the cell;

rotating the cap into a rotationally engaged position; and raising the cap away from the cell such that the plurality of ears seat against the plurality of tabs.

16. The method of claim 15 wherein rotating the cap into a rotationally engaged position comprises rotating the cap until a rotational limit pin rests against one of the plurality of ears, the rotational limit pin extending axially from the axial recess defined on the inner surface.

17. The method of claim 16 wherein rotating the cap into a rotationally engaged position further comprises, rotating the cap until a locking pin protruding axially from at least one of the plurality of tabs aligns with a groove defined on at least one of the plurality of ears.

18. The method of claim 17 wherein raising the cap away from the cell further comprises engaging the locking pin with the groove.

19. The method of claim 15 wherein raising the cap away from the cell further comprises axially-offsetting the radial recess and the ring from the at least one secondary relief dimple such that the ring seals against the inner surface of the cell.

20. The method of claim 15 further comprising:

pressurizing the pressure vessel by injecting a fluid from a pressuring source;

heating the pressure vessel using a heating jacket disposed about the pressure vessel; and filtering the drilling fluid through a filter system disposed in the cap.

* * * * *